US008525737B2

(12) United States Patent
Rho et al.

(10) Patent No.: US 8,525,737 B2
(45) Date of Patent: Sep. 3, 2013

(54) ANTENNA ASSEMBLY AND PORTABLE TERMINAL HAVING THE SAME

(75) Inventors: Sungjung Rho, Seoul (KR); Jaegon Lee, Seoul (KR); Ansun Hyun, Seoul (KR); Yochuol Ho, Seongnam (KR); Euntaek Jeoung, Anyang (KR)

(73) Assignee: LG Electronics Inc., Seoul (KR)

( * ) Notice: Subject to any disclaimer, the term of this patent is extended or adjusted under 35 U.S.C. 154(b) by 384 days.

(21) Appl. No.: 12/875,604

(22) Filed: Sep. 3, 2010

(65) Prior Publication Data

US 2011/0057859 A1 Mar. 10, 2011

(30) Foreign Application Priority Data

Sep. 4, 2009 (KR) ..... 10-2009-0083659

(51) Int. Cl.
*H01Q 1/24* (2006.01)

(52) U.S. Cl.
USPC ..... 343/702; 343/909

(58) Field of Classification Search
USPC ..... 343/700 MS, 702, 909, 749, 846
See application file for complete search history.

(56) References Cited

U.S. PATENT DOCUMENTS

| | | | | |
|---|---|---|---|---|
| 6,111,544 | A * | 8/2000 | Dakeya et al. | 343/700 MS |
| 2003/0214441 | A1 * | 11/2003 | Back et al. | 343/700 MS |
| 2007/0229363 | A1 * | 10/2007 | Kurashima et al. | 343/700 MS |
| 2008/0079642 | A1 * | 4/2008 | Ishizuka et al. | 343/702 |

* cited by examiner

*Primary Examiner* — Dieu H Duong
(74) *Attorney, Agent, or Firm* — KED & Associates, LLP

(57) ABSTRACT

An antenna assembly includes a patch coupled to a first board, a conductive pattern coupled to a second board, a first connector electrically coupled to the patch, and a second connector to couple the conductive pattern to a circuit of the first board. The patch has a first section adjacent a first surface and a second section adjacent an opposing second surface of the second board, and the first connector electrically couples the first section to the second section of the patch. The assembly may include a plurality of antennas, and portable terminal may use the assembly to communicate in different frequency bands.

18 Claims, 8 Drawing Sheets

ANTENNA ASSEMBLY AND PORTABLE TERMINAL HAVING THE SAME

CROSS-REFERENCE TO A RELATED APPLICATION

Pursuant to 35 USC §119(a), this application claims the benefit of priority to Korean Application 10-2009-0083659, filed on Sep. 4, 2009, the content of which is incorporated by reference herein in its entirety.

BACKGROUND

1. Field

One or more embodiments described herein relate to signal communication.

2. Background

A portable terminal is a device that can be carried around and has one or more functions such as voice and video call communication, inputting and outputting information, storing data, and the like.

As such functions become more diversified, the portable terminal can support more complicated functions such as capturing images or video, reproducing music or video files, playing games, receiving broadcast signals, and the like. By comprehensively and collectively implementing such functions, the portable terminal may be embodied in the form of a multimedia player or device.

In order to implement various functions of such multimedia players or devices, the multimedia player requires sufficient support in terms of hardware or software, for which numerous attempts are being made and implemented. For example, a user interface allowing users to easily and conveniently search for and select one or more functions is provided.

An external type antenna has firstly developed to be mounted to the portable terminal in an exposed status to the outside. However, an internal type antenna (built-in antenna) is being commercialized with consideration of the appearance of the portable terminal.

As the portable terminal becomes small and slim, it is difficult for the built-in antenna to have a length long enough to implement required communication quality. And, the built-in antenna may be easily influenced by other metallic components.

DETAILED DESCRIPTION

A terminal may be implemented in various types. For instance, the terminal in the present description includes a portable terminal such as a portable phone, a smart phone, a notebook computer, a digital broadcasting terminal, Personal Digital Assistants (PDA), Portable Multimedia Player (PMP), a navigation system, and a fixed terminal such as a digital TV, a desktop computer, etc.

Figure 1A:
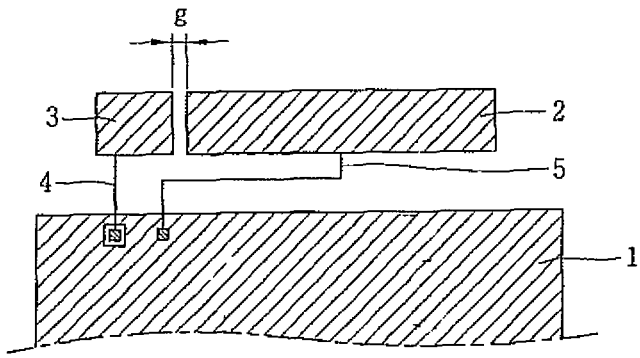
FIG. 1A is a view schematically showing one embodiment of an antenna.
Figure 1B:
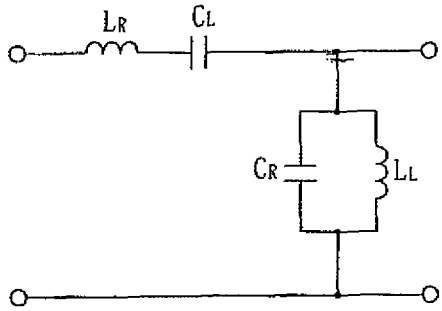
FIG. 1B is an equivalent circuit view of FIG. 1A.

FIG. 1A is a planar view schematically showing one embodiment of an antenna according to the present invention, and FIG. 1B is an equivalent circuit view of FIG. 1A. The antenna shown in FIG. 1A includes a pattern portion 3 for feeding, and a patch portion 2 spacing from the pattern portion 3. The pattern portion 3 and the patch portion 2 are spacing from each other by a predetermined gap (g), and are arranged such that an electric coupling is implemented therebetween.

The pattern portion 3 is connected to a circuit board 1 by a feeding line 4, and the patch portion 2 is connected to a ground portion of the circuit board 1 by a ground wire 5. The patch portion 2 and the ground wire 5 are configured to generate a zero$^{th}$ order resonance (ZOR), and serve as a capacitance and an inductance, respectively. As shown in FIG. 1Bd, a serial capacitance and a parallel inductance are formed to implement a composite right/left handed (CRLH) transmission line.

When using the CRLH transmission line, a slim and small configuration of the antenna is implemented as the zero$^{th}$ order resonance occurs. The CRLH transmission line may be formed of a metallic material which artificially replaces a non-existent material in nature. A general transmission line resonator (TLR) is implemented in a first positive mode, a second positive mode, i.e., a positive mode. However, a transmission line resonator formed of a metallic material is implemented in a negative mode, a zero$^{th}$ mode, and a positive mode. In this case, since the resonator is not influenced by the length of the antenna, the antenna may have a compact configuration. Furthermore, since the portable terminal is less influenced by the ground portion of the circuit board, sharing of the antenna may be implemented. And, a specific absorption ratio (SAR) may be reduced by concentrating an electromagnetic wave only to the periphery of the antenna.

When the patch portion 2 has a large area, radiation efficiency is increased. However, in this case, an installation space of the antenna inside the portable terminal is decreased. Accordingly, it is required to form the patch portion 2 so as to have a modified structure.

Figure 2A:
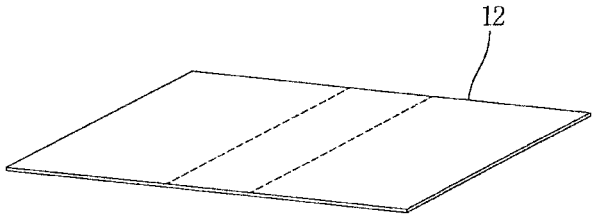
FIG. 2 is a perspective view schematically showing a modification example of a patch portion.
Figure 2B:
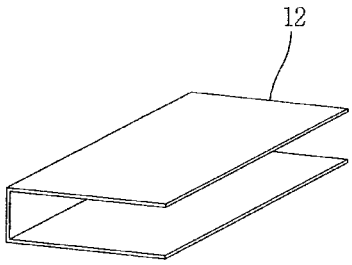

FIG. 2 is a perspective view schematically showing a modification example of the patch portion. As shown in FIG. 2A, a patch portion 12 may be designed so as to have an area large enough to increase radiation efficiency. However, in this case, it is difficult to mount the patch portion 12 in the portable terminal. Accordingly, the patch portion 12 may be fabricated in the form of a folded patch. The folded path may have a small size, and may be advantageous to miniaturization of the antenna since its thickness is not thick.

Figure 3:
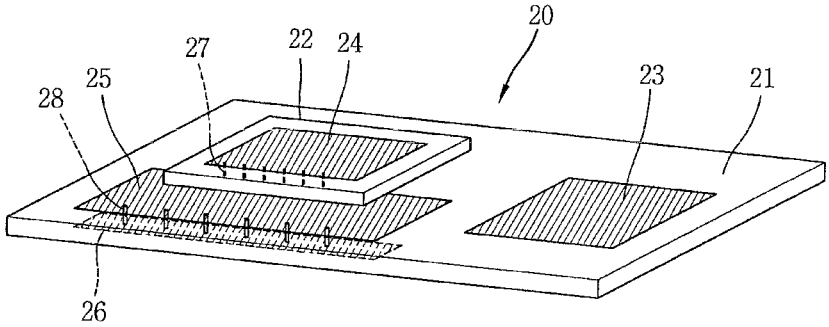
FIG. 3 is a view schematically showing a multi-resonance antenna assembly.

FIG. 3 is a perspective view schematically showing a multi-resonance antenna assembly. Referring to FIG. 3, an antenna assembly 20 includes a first board 21, and a second board 22 stacked on the first board 21. The antenna assembly 20 may be configured to operate at two or more bands, and an antenna which operates at a low band may be implemented in the form of the first board 21 and the second board 22 stacked to each other.

The multiple bands may indicate combination of the following bands, and the low band may indicate a relatively lower band among a plurality of bands. However, the multiple bands may be implemented by combining various bands rather than the following bands with each other.

(1) Dual band: DCN (GSM) band (824~894 MHz), USPCS band (1850~1990 MHz)

(2) Quad band: GSM (DCN) band (824~894 MHz), PCS band (1850~1990 MHz), W2100 band (1920~2170 MHz)

(3) Penta band: GSM band, EGSM band (880~960 MHz), DCS band (1710~1880 MHz), PCS band, W2100 band In case of the dual band and the quad band, a GSM band antenna is implemented in the form of stacked boards. On the other hand, in case of the penta band, a GSM band antenna and an EGSM band antenna may be implemented in the form of stacked boards.

Referring to FIG. 3, a conducive pattern 24 having a predetermined area is formed on an upper surface of the second board 22. The conductive pattern 24 may serve as an emitter of an antenna which covers a low band, or may serve as a part of an antenna structure for forming a CRLH transmission line.

The conductive pattern 24 is connected to the first board 21 by one or more connection members 27 penetratingly formed at the second board 22. The connection members 27 may be implemented as via holes or screw holes. These connection members 27 do not cause the antenna assembly 20 to have an increased thickness, whereas they allow the conductive pattern 24 to have an increased area. On the other hand, the stacked structure having the second board 22 enhances radiation efficiency due to a height difference between the conductive pattern 24 and the first patch portion 25 when compared with the antenna structure implemented only by the first board 21.

For implementation of the folded patch, a first portion 26 and a second patch portion 25 are formed on a lower surface and an upper surface of the first board 21. And, the first patch portion 26 and the second patch portion 25 are connected to each other by connection members 28 implemented in the form of via holes or screw holes. The connection members 28 may be formed in plurality in number so as to obtain larger connection areas. This may allow the antenna to have an increased entire area without increasing a planar area in a state that the first path portion 26 and the second patch portion 25 are arranged on different surfaces of the first board 21. Differently from the arrangement shown in FIG. 3, the first patch portion 26 may be arranged on a lower surface of the second board 22, and the second patch portion 25 may be arranged on an upper surface of the first board 21.

The conductive pattern 24, the first patch portion 26, and the second patch portion 25 have heights different from one another, and implement a folded patch electrically connected to one another by the connection members 27 and 28. Accordingly, the antenna structure having the first and second boards 21 and 22 implements more enhanced wireless characteristics when compared with the antenna structure having only the first board 21 on which the first patch portion 26 and the second patch portion 25 are formed.

A conductor 23 may be formed at one side of the first board 21. The conductor 23 may be formed to implement high bands, and may be configured to operate at one or more bands selected from the aforementioned DCS band (1710~1880 MHz), PCS band (1850~1990 MHz), W2100 band (1920~2170 MHz), etc.

The conductor 23 may be arranged on an upper surface of the first board 21 with a predetermined gap from the second patch portion 25. The predetermined gap may allow electromagnetic coupling between the conductor 23 and the second patch portion 25, thereby enhancing a wireless characteristic at a low band.

Figure 4:
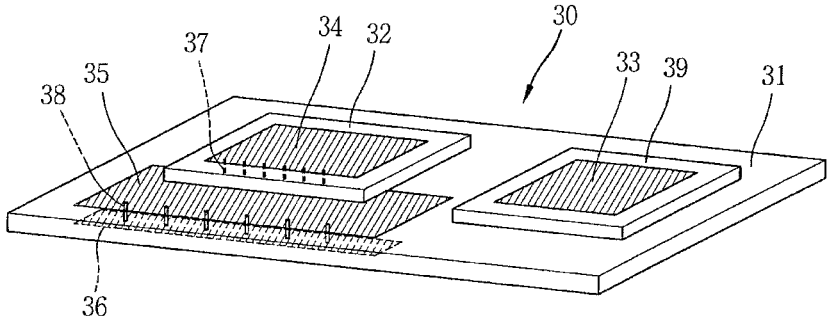
FIGS. 4 and 5 are views showing other examples of an antenna assembly.
Figure 5:
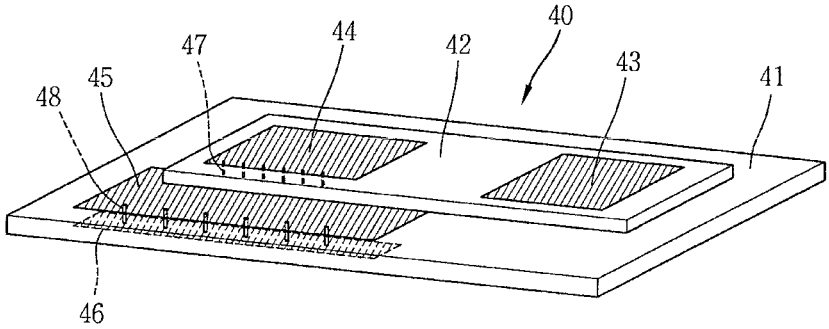

FIGS. 4 and 5 show other examples of the antenna assembly. Referring to FIG. 4, not only a second board 32 but also a third board 39 are arranged on a first board 31. As aforementioned, a conductive pattern 34 is formed on an upper surface of the second board 32, and is connected to the first board 31 by connection members 37. For implementation of a folded patch, a first patch portion 36 and a second patch portion 35 may be formed on a lower surface and an upper surface of the first board 31.

A conductor 33 in FIG. 4 is different from the aforementioned conductor in that it is formed on the third board 39, not on the first board 31. In this case, the conductor 33 may be implemented as a part of a high band antenna, or may be a part of an antenna which covers a band higher than a low band of an antenna consisting of the conductive pattern 34, the first patch portion 36, and the second patch portion 35. For instance, in case of the penta band, the conductor 33 may be configured to cover the EGSM band.

FIG. 5 shows that a conductive pattern 44 and a conductor 49 are formed on one board 41. This may allow the conductive pattern and the conductor to be more easily fabricated with lower costs when compared with the case that they are formed on different boards. Explanations for other components rather than the conductive pattern 44, the conductor 49, and the board 41 will be omitted.

Figure 6:
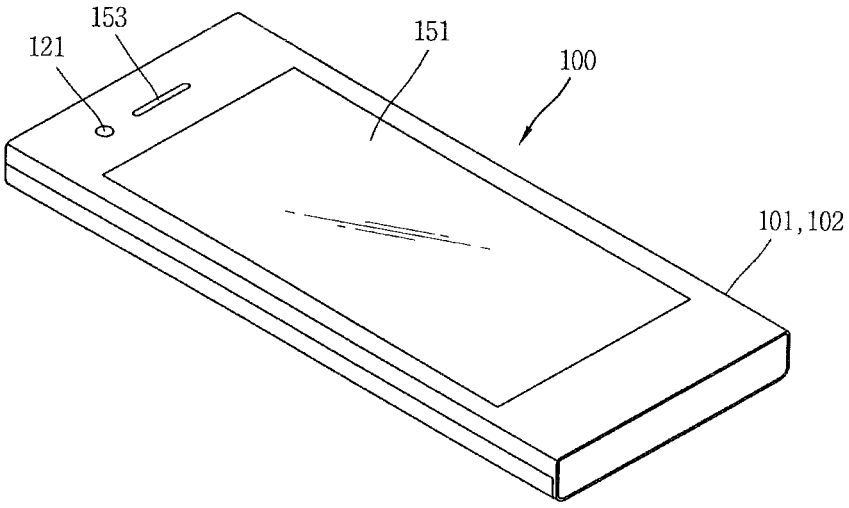
FIG. 6 is a front perspective view of a portable terminal to which the antenna assembly has been mounted.

FIG. 6 is a front perspective view of a portable terminal to which the antenna assembly has been mounted. The portable terminal 100 as illustrated has a bar-shaped terminal body. However, without being limited thereto, the portable terminal can be applicable to various structures such as a slide type portable terminal, a folder type portable terminal, a swing type portable terminal, a swivel type portable terminal, and the like, having two or more bodies which are coupled to be relatively movable.

The case (or casing, housing, cover, etc.) constituting the external appearance of the terminal body includes a front case 101 and a rear case 102. Various electronic components are installed in the space between the front case 101 and the rear case 102. At least one intermediate case may be additionally disposed between the front case 101 and the rear case 102. The cases may be formed by injection-molding a synthetic resin or may be made of a metallic material such as stainless steel (STS) or titanium (Ti), etc.

A display unit 151, an audio output unit 152, a video input unit 121, etc. may be disposed on the front surface of the terminal body.

The display unit 151 may be implemented as a liquid crystal display (LCD) module for visually displaying information, an organic light emitting diode (OLED) module, an e-paper, and the like. The display unit 151 may include a touch sensing unit allowing for an inputting operation in a tactile manner. Thus, when a point on the display unit 151 is touched, content corresponding to the touched position is inputted. The content inputted in the tactile manner may be characters, numbers, menu items that can be indicated or designated in various modes, and the like. The touch sensing unit may be light-transmissive to allow the display unit 151 to be seen, and may have a structure for enhancing visibility of the touch screen in a bright area.

The audio output unit 152 may be implemented in the form of a receiver that transfers a speaker sound to the user's ear, or in the form of a loud speaker for outputting various alarm sounds or a multimedia reproduction sound of the portable terminal 100.

The video input unit 121 may be implemented in the form of a camera for capturing an image. As shown in FIG. 6, the video input unit 121 disposed on the front side of the terminal body may be utilized to capture a user's face during a video call. The video input unit 121 may be additionally installed on a rear surfaced of the terminal body.

Figure 7:
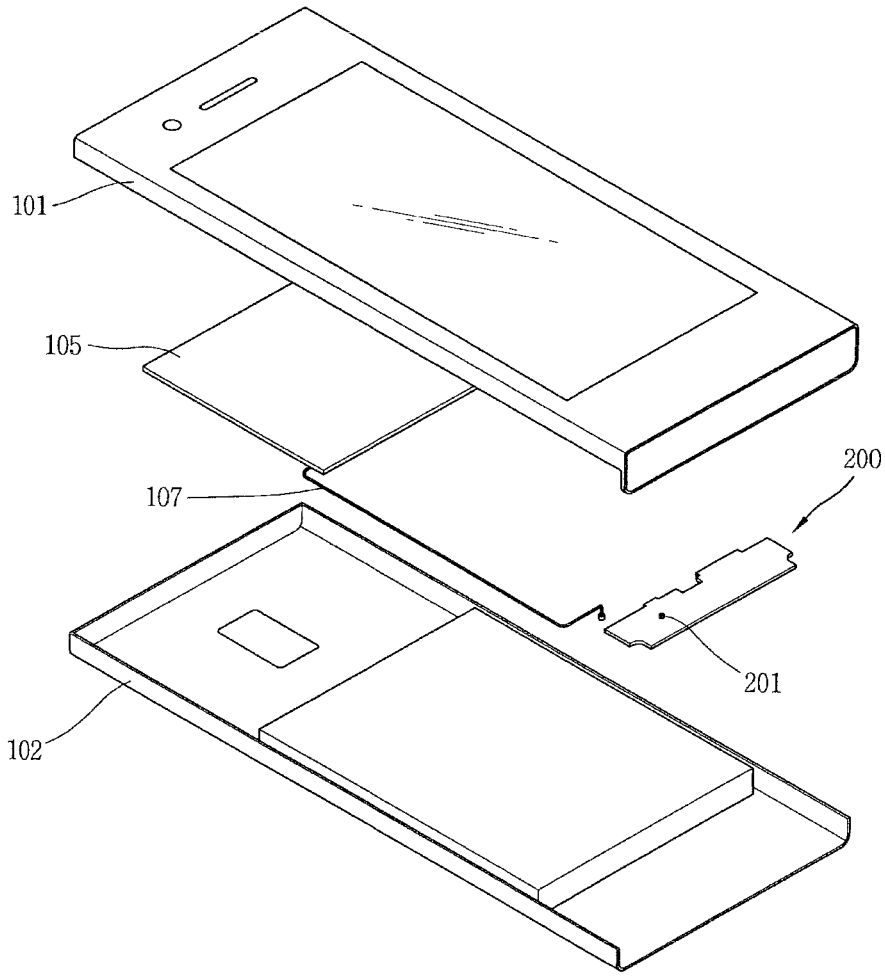
FIG. 7 is an exploded perspective view of the portable terminal of FIG. 6.

FIG. 7 is an exploded perspective view of the portable terminal of FIG. 6. Referring to FIG. 7, the body of the portable terminal 100 may include the front case 101 and the rear case 102. Various components may be arranged between the front case 101 and the rear case 102. However, FIG. 7 illustrates only an antenna assembly 200, a main board 105 to which the antenna assembly 200 is connected, and an electric wire 107 configured to connect the antenna assembly 200 and the main board 105 with each other. A detailed structure of the antenna assembly 200 will be later explained with reference to FIGS. 8 to 10.

The antenna assembly 200 may be arranged at one corner of the terminal body so as to be less influenced by other components. Since the antenna assembly 200 is spaced from the main board 105 by a predetermined distance, the antenna assembly 200 is connected to the main board 105 by an electric wire. For connection with the electric wire 107, the antenna assembly 200 may be provided with a coaxial connector 201. And, the electric wire 107 may be implemented in the form of a coaxial cable.

Figure 8:
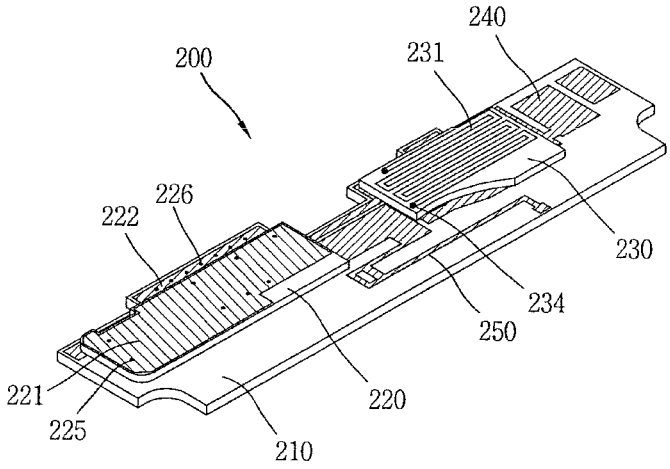
FIG. 8 is an upper perspective view of the antenna assembly that may be mounted to the portable terminal of FIG. 7.
Figure 9:
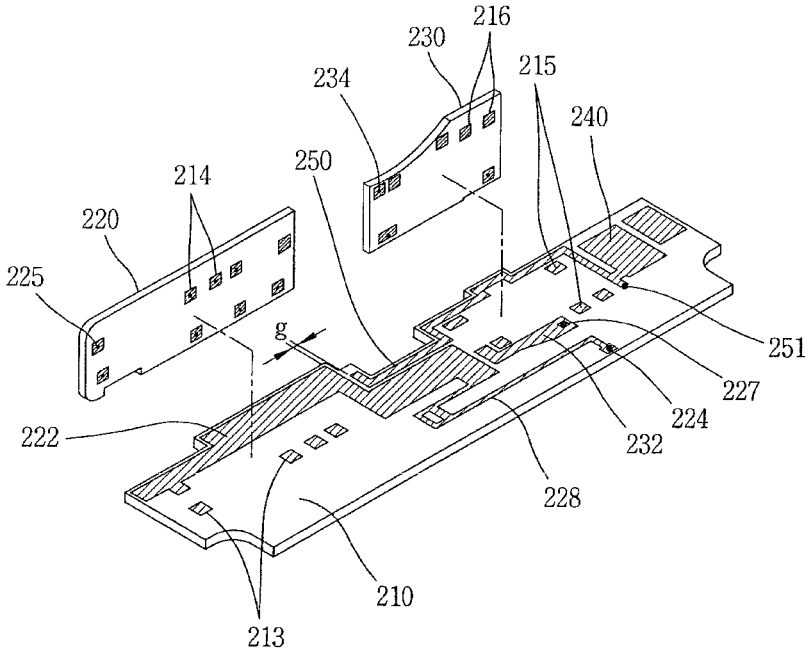
FIG. 9 is a disassembled perspective view of a second board and a third board of the antenna assembly of FIG. 8.
Figure 10:
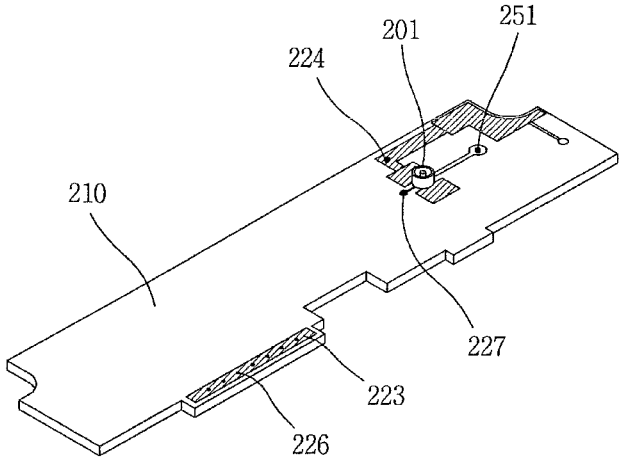
FIG. 10 is a rear perspective view of the antenna assembly of FIG. 8.

FIG. 8 is an upper perspective view of the antenna assembly that may be mounted to the portable terminal of FIG. 7, FIG. 9 is a disassembled perspective view of a second board and a third board of the antenna assembly of FIG. 8, and FIG. 10 is a rear perspective view of the antenna assembly of FIG. 8.

As shown in FIGS. 8 to 10, the antenna assembly 200 comprises a first board 210, a second board 220, and a third board 230. The second board 220 and the third board 230 may be attached to the first board 210 by soldering. In this case, automatic productions may be facilitated and the fabrication costs may be reduced. As shown in FIG. 9, a plurality of pads 213, 214, 215 and 216 are formed on an upper surface of the first board 210, and on lower surfaces of the second and third boards 220 and 230, respectively.

This preferred embodiment discloses the antenna assembly 200 which covers a penta-band. A conductive pattern 221, a first patch portion 223, and a second patch portion 222 serve to form a folded patch, and are connected to ground by a ground wire 228. More specifically, the first patch portion 223 and the second patch portion 222 are formed on a lower surface and an upper surface of the first board 210, respectively. And, the first patch portion 223 and the second patch portion 222 are connected to each other by one or more connection vias 226 penetratingly formed at the first board 210.

A conductor 250 is formed on an upper surface of the first board 210 near the second board 220, and has a length long enough to cover a DCS band and a PCS band. The conductor 250 forms a predetermined pattern on the upper surface of the first board 210, and is extending from a predetermined position to the first board 210 through one or more connection vias 251. Then, the conductor 250 is connected to a feeding portion 201.

A conductor 240 is connected to one side of the conductor 250, and is formed to cover a high band such as W2100. The two conductors 240 and 250 are formed to cover three high bands among the penta-band. And, the two conductors 240 and 250 are designed to occupy a minimized area and to implement minimized functions on the first board 210 having a limited size. It is possible for the two conductors 240 and 250 to have variously modified positions and shapes. For instance, at least one of the two conductors 240 and 250 may be arranged on a lower surface or a side surface of the first board 210, or may include an additional board. Furthermore, at least one of the two conductors 240 and 250 may be implemented by using the conventional dielectric carrier.

A meander line pattern 231 is formed on an upper surface of the third board 230 so as to implement a height effect. The meander line pattern 231 is configured to cover a low band such as an EGSM band, and includes one or more connection vias 234 at its ends. The meander line pattern 231 is connected to the first board 210 through the connection vias 234, and is connected to the feeding portion 201 through the conductor and one or more connection vias 227 of the first board 210.

A ground wire 250 connected to the second patch portion 222, and a gap (g) for electromagnetic coupling between the second patch portion 222 and the conductor 250 serve to implement a CRLH transmission line. This structure is suitable for coverage of a low band such as a GSM band. The patch portions 223 and 222 and the conductive pattern 221 occupy a considerable area on the first board 210 due to coverage of a low band. Accordingly, as shown in FIGS. 8 to 10, a stack type folded patch is formed by using the second board 220. This may allow the antenna assembly to have a minimized mounting volume or area, and to have a small and slim structure.

As aforementioned, the second board 220 and the third board 230 may be implemented in the form of one board. Also, the meander line pattern 231 may be directly formed on the first board 210, rather than on the third board 230.

Figure 11:
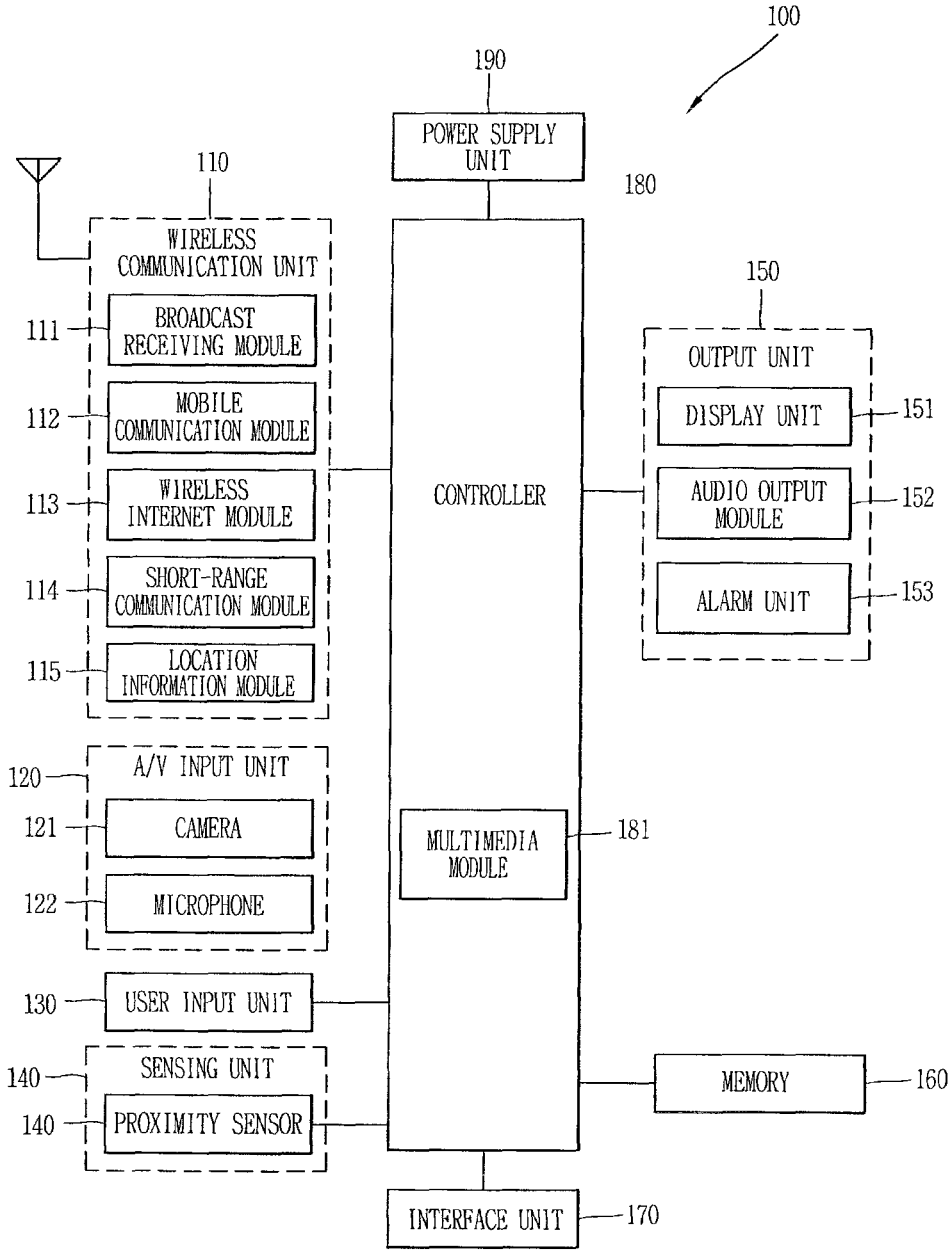
FIG. 11 is a block diagram of one embodiment of a portable terminal.

FIG. 11 is a block diagram of one embodiment of a portable terminal 100 which includes a wireless communication unit 110, an A/V (Audio/Video) input unit 120, a user input unit 130, a sensing unit 140, an output unit 150, a memory unit 160, an interface unit 170, a controller 180, and a power supply unit 190, etc. The components as shown in FIG. 11 are not a requirement, and greater or fewer components may alternatively be implemented.

The wireless communication unit 110 may include one or more components allowing radio communication between the portable terminal 100 and a wireless communication system or a network in which the portable terminal is located. For example, the wireless communication unit may include a broadcast receiving module 111, a mobile communication module 112, a wireless Internet module 113, a short-range communication module 114, and a location information module 115, etc.

The broadcast receiving module 111 receives broadcast signals and/or broadcast associated information from an external broadcast management server via a broadcast channel. The broadcast channel may include a satellite channel and a terrestrial channel. The broadcast management server may refer to a server that generates and transmits a broadcast signal and/or broadcast associated information or a server that receives a previously generated broadcast signal and/or broadcast associated information and transmits the same to a terminal.

The broadcast signal may include not only a TV broadcast signal, a radio broadcast signal and a data broadcast signal, but also a broadcast signal obtained by coupling a data broadcast signal to the TV or radio broadcast signal. The broadcast associated information may be information related to a broadcast channel, a broadcast program or a broadcast service provider. The broadcast associated information may be provided via a mobile communication network. In this case, the broadcast associated information may be received by the mobile communication module 112.

The broadcast associated information may exist in various forms. For example, it may exist in the form of an electronic program guide (EPG) of digital multimedia broadcasting (DMB), electronic service guide (ESG) of digital video broadcast-handheld (DVB-H), etc.

The broadcast receiving module 111 may receive digital broadcast signals by using digital broadcast systems such as multimedia broadcasting-terrestrial (DMB-T), digital multimedia broadcasting-satellite (DMB-S), media forward link only (MediaFLO®), digital video broadcast-handheld (DVB-H), integrated services digital broadcast-terrestrial (ISDB-T), etc. The broadcast receiving module 111 may be configured to be suitable for any other broadcast systems as well as the above-described digital broadcast systems.

Broadcast signals and/or broadcast-associated information received via the broadcast receiving module 111 may be stored in the memory unit 160.

The mobile communication module 112 transmits and receives radio signals to and from at least one of a base station, an external terminal and a server. Such radio signals may include a voice call signal, a video call signal or various types of data according to text/multimedia message transmission and reception.

The wireless Internet module 113 refers to a module for a wireless Internet access. This module may be internally or externally coupled to the terminal. The wireless Internet technique may include a WLAN (Wireless LAN) (Wi-Fi), Wibro (Wireless broadband), Wimax (World Interoperability for Microwave Access), HSDPA (High Speed Downlink Packet Access), etc.

The short-range communication module 114 refers to a module for short-range communication. As the short range communication technologies, Bluetooth, radio frequency identification (RFID), infrared data association (IrDA), ultra-wideband (UWB), ZigBee, etc., may be used.

The location information module 115 is a module for checking or acquiring a location (or position) of the portable terminal. A typical example of the location information module is a GPS (Global Positioning System). According to the current technology, the GPS module 115 calculates distance information from three or more satellites and accurate time information and applies trigonometry to the calculated information to thereby accurately calculate three-dimensional current location information according to latitude, longitude, and altitude. Currently, a method for calculating location and time information by using three satellites and correcting an error of the calculated location and time information by using another one satellite. In addition, the GPS module 115 can calculate speed information by continuously calculating the current location in real time.

The A/V input unit 120 is configured to receive an audio or video signal. The A/V input unit 120 may include a camera 121 and a microphone 122. The camera 121 processes image data of still pictures or video obtained by an image capture device in a video capturing mode or an image capturing mode. The processed image frames may be displayed on a display unit 151 (or other visual output device).

The image frames processed by the camera 121 may be stored in the memory unit 160 or transmitted via the wireless communication unit 110. Two or more cameras 121 may be provided according to the configuration of the portable terminal.

The microphone 122 may receive sounds (audible data) via a microphone or the like in a phone call mode, a recording mode, a voice recognition mode, and the like, and can process such sounds into audio data. The processed audio (voice) data may be converted for output into a format transmittable to a mobile communication base station via the mobile communication module 112 in case of the phone call mode. The microphone 122 may implement various types of noise canceling (or suppression) algorithms to cancel (or suppress) noise or interference generated in the course of receiving and transmitting audio signals.

The user input unit 130 (or other user input device) may generate key input data from commands entered by a user to control various operations of the portable terminal. The user input unit 130 allows the user to enter various types of information, and may include a keypad, a dome switch, a touch pad (e.g., a touch sensitive member that detects changes in resistance, pressure, capacitance, etc. due to being contacted) a jog wheel, a jog switch, and the like. In particular, when the touch pad is overlaid on the display unit 151 in a layered manner, it may form a touch screen.

The sensing unit 140 detects a current status (or state) of the portable terminal 100 such as an opened or closed state of the portable terminal 100, a location of the portable terminal 100, the presence or absence of user contact with the portable terminal 100 (i.e., touch inputs), the orientation of the portable terminal 100, an acceleration or deceleration movement and direction of the portable terminal 100, etc., and generates commands or signals for controlling the operation of the portable terminal 100. For example, when the portable terminal 100 is implemented as a slide type mobile phone, the sensing unit 140 may sense whether the slide phone is opened or closed.

In addition, the sensing unit 140 can detect whether or not the power supply unit 190 supplies power or whether or not the interface unit 170 is coupled with an external device. Meanwhile, the sensing unit 140 may include a proximity sensor 141. The proximity sensor 141 will be described in relation to a touch screen later.

The interface unit 170 serves as an interface by which at least one external device may be connected with the portable terminal 100. For example, the external devices may include wired or wireless headset ports, an external power supply ports, wired or wireless data ports, memory card ports, ports for connecting a device having an identification module, audio input/output (I/O) ports, video I/O ports, earphone ports, or the like.

The identification module may be a chip that stores various information for authenticating user's authority for using the portable terminal 100 and may include a user identity module (UIM), a subscriber identity module (SIM) a universal subscriber identity module (USIM), and the like. In addition, the device having the identification module (referred to as the 'identifying device', hereinafter) may take the form of a smart card. Accordingly, the identifying device may be connected with the terminal 100 via a port or other connection means. The interface unit 170 may be used to receive inputs (e.g., data, information, power, etc.) from an external device and transfer the received inputs to one or more elements within the portable terminal 100 or may be used to transfer data between the portable terminal and an external device.

In addition, when the portable terminal 100 is connected with an external cradle, the interface unit 170 may serve as a conduit to allow power from the cradle to be supplied therethrough to the portable terminal 100 or may serve as a conduit to allow various command signals inputted from the cradle to be transferred to the portable terminal therethrough. Various command signals or power inputted from the cradle may operate as a signal for recognizing that the portable terminal is accurately mounted on the cradle.

The output unit 150 is configured to provide outputs in a visual, audible, and/or tactile manner (e.g., audio signal, video signal, alarm signal, vibration signal, etc.). The output unit 150 may include the display unit 151, an audio output module 152, an alarm unit 153, and the like.

The display unit 151 may display information processed in the portable terminal 100. For example, when the portable terminal 100 is in a phone call mode, the display unit 151 may display a User Interface (UI) or a Graphic User Interface (GUI) associated with a call or other communication (such as text messaging, multimedia file downloading, etc.). When the portable terminal 100 is in a video call mode or image capturing mode, the display unit 151 may display a captured image and/or received image, a UI or GUI that shows videos or images and functions related thereto, and the like.

Meanwhile, when the display unit 151 and the touch pad are overlaid in a layered manner to form a touch screen, the display unit 151 may function as both an input device and an output device. The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like.

The proximity sensor 141 may be disposed within or near the touch screen. The proximity sensor 141 is a sensor for detecting the presence or absence of an object relative to a certain detection surface or an object that exists nearby by using the force of electromagnetism or infrared rays without a physical contact. Without the proximity sensor 141, if the touch screen is an electrostatic type, the approach of a pointer (stylus) can be detected based on a change in a field according to the approach of the pointer.

The audio output module 152 may convert and output as sound audio data received from the wireless communication unit 110 or stored in the memory unit 160 in a call signal reception mode, a call mode, a record mode, a voice recognition mode, a broadcast reception mode, and the like. Also, the audio output module 152 may provide audible outputs related to a particular function performed by the portable terminal 100 (e.g., a call signal reception sound, a message reception sound, etc.). The audio output module 152 may include a speaker, a buzzer, or other sound generating device.

The alarm unit 153 (or other type of user notification means) may provide outputs to inform about the occurrence of an event of the portable terminal 100. Typical events may include call reception, message reception, key signal inputs, a touch input etc. In addition to audio or video outputs, the alarm unit 153 may provide outputs in a different manner to inform about the occurrence of an event. For example, the alarm unit 153 may provide an output in the form of vibrations (or other tactile or sensible outputs). When a call, a message, or some other incoming communication is received, the alarm unit 153 may provide tactile outputs (i.e., vibrations) to inform the user thereof. By providing such tactile outputs, the user can recognize the occurrence of various events even if his mobile phone is in the user's pocket. Outputs informing about the occurrence of an event may be also provided via the display unit 151 or the audio output module 152.

The memory unit 160 may store software programs or the like used for the processing and controlling operations performed by the controller 180, or may temporarily store data (e.g., a phonebook, messages, still images, video, etc.) that have been outputted or which are to be outputted. In addition, the memory unit 160 may store data regarding various patterns of vibrations and sounds outputted when a touch is applied onto the touch screen.

The memory unit 160 may include at least one type of storage medium including a Flash memory, a hard disk, a multimedia card, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only Memory (PROM), a magnetic memory, a magnetic disk, an optical disk, and the like. Also, the portable terminal 100 may cooperate with a network storage device that performs the storage function of the memory unit 160 over a network connection.

The controller 180 typically controls the general operations of the portable terminal. For example, the controller 180 performs controlling and processing associated with voice calls, data communications, video calls, and the like. In addition, the controller 180 may include a multimedia module 181 for reproducing (or playing back) multimedia data. The multimedia module 181 may be configured within the controller 180 or may be configured to be separate from the controller 180.

The controller 180 may perform a pattern recognition processing to recognize a handwriting input or a picture drawing input performed on the touch screen as characters or images.

The power supply unit 190 receives external power (via a power cable connection) or internal power (via a battery of the portable terminal) and supplies appropriate power required for operating respective elements and components under the control of the controller 180.

In the antenna assembly according to the present invention, the stacked boards are used as an antenna structure. This may enhance a height effect when compared to a case where the conductive pattern is formed on a single board. Furthermore, the antenna structure implemented as the stacked boards may enhance a wireless characteristic at a low band when implementing a folded patch antenna. And, an installation space or area occupied by the antenna may be minimized, thereby reducing the entire size of the portable terminal.

One or more embodiments described herein is to provide a portable terminal having a slim configuration through enhancement of a built-in antenna mounting structure. Another object is to provide an antenna having an enhanced wireless function at a low band in an antenna module which operates at multiple bands.

To achieve these and other advantages and in accordance with the purpose of the present invention, as embodied and broadly described herein, there is provided an antenna assembly, comprising: a first board; and a plurality of antennas installed on the first board, and configured to operate at multiple bands, wherein one or more antennas configured to operate at a low band among the multiple bands of the plurality of antennas comprises: a second board stacked on an upper surface of the first board; a conductive pattern disposed on an upper surface of the second board; and one or more connection members penetratingly formed at the second board, and configured to connect the conductive pattern to a lower surface of the second board.

The second board may be attached to the first board by soldering.

A first patch portion and a second patch portion may be formed on a lower surface and an upper surface of the first board, respectively. And, the second patch portion may be configured to be connected to the connection members.

On the upper surface of the first board where the second patch portion is located, may be further provided a ground wire connected from the second patch portion to ground via the first board.

The conductive pattern may be configured in the form of a patch.

The second patch portion may be formed on a lower surface of the second board, rather than on the upper surface of the first board. The connection members may be configured in the form of via holes. The plurality of antennas may be provided with a feeding portion formed on the first board. The feeding portion may be configured in the form of a coaxial connector. The conductive pattern may be disposed on an upper surface of the second board in the form of meander lines. Another antenna which operates at a high band may be arranged on an upper surface of the first board near the second board. The portable terminal may have the antenna assembly mounted thereto.

According to another aspect of the present invention, there is provided an antenna assembly, comprising: a first board; and a plurality of antennas installed on the first board, and configured to operate at multiple bands, wherein a first antenna configured to operate at a low band among the multiple bands of the plurality of antennas comprises: a second board stacked on an upper surface of the first board; a first conductive pattern disposed on an upper surface of the second board; and a plurality of first connection members configured to connect the first conductive pattern to a lower surface of the second board, and wherein a second antenna configured to operate at a second-low band among the multiple bands of the plurality of antennas comprises: a third board stacked on an upper surface of the first board with a distance from the second board; a second conductive pattern disposed on an upper surface of the third board; and a plurality of second connection members configured to connect the second conductive pattern to a lower surface of the third board. The second and third boards may be configured in the form of one board.

A first patch portion and a second patch portion may be formed on a lower surface and an upper surface of the first board, respectively. And, the second patch portion may be configured to be connected to the first connection members.

On the upper surface of the first board where the second patch portion is located, may be further provided a ground wire connected from the second patch portion to ground via the first board. The first conductive pattern may be configured in the form of a patch. The second conductive pattern may be disposed on an upper surface of the third board in the form of meander lines. The second and third boards may be attached to the first board by soldering, respectively. One or more antennas which operate at a high band may be arranged on an upper surface of the first board near the second and third boards.

In the foregoing description, usage of suffixes such as 'module', 'part' or 'unit' used for referring to elements is given merely to facilitate explanation of the present invention, without having any significant meaning by itself.

According to another embodiment, an antenna assembly includes a patch coupled to a first board; a conductive pattern coupled to a second board; a first connector electrically coupled to the patch; and a second connector to couple the conductive pattern to a circuit of the first board. The patch has a first section adjacent a first surface and a second section adjacent an opposing second surface of the second board, and the first connector electrically couples the first section to the second section of the patch.

The first connector penetrates through the first board and the second connector penetrates through the second board. In addition, a ground wire coupled to the first section of the patch. Furthermore, conductive pattern is configured in a form of a patch. The patch and conductive pattern form a first antenna to operating in a first band.

The assembly may further include a second antenna having a conductor coupled to one of the first board or the second board, wherein the first and second antennas operate in different frequency bands. A feeding portion of the first and second antennas is formed on the first board and may be configured in the form of a coaxial connector. The conductive pattern may include a predetermined number of meander lines.

In addition, the assembly may include a third board and a second antenna including a conductor coupled to the third board, wherein the first and second antennas operate in different frequency bands. The third board is coupled to the first board.

According to another embodiment, a portable terminal includes a body and an antenna assembly according to any of the aforementioned embodiments coupled to the body.

Any reference in this specification to 'one embodiment,' 'an embodiment,' 'example embodiment,' etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Moreover, the features of one embodiment maybe combined with the features of other embodiments as described herein.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable terminal, comprising:

a body having a circuit board; and an antenna assembly coupled to the body and including:

a first board, a first patch portion disposed on a first surface of the first board, a second patch portion disposed on a second surface of the first board, a first connection member to electrically couple the first patch portion to the second patch portion, and a conductor arranged within a predetermined gap from the second patch portion such that a capacitive coupling provided between the conductor and the second patch portion, wherein the second patch portion is connected to a ground portion of the circuit board by a ground wire for implementing a composite right/left handed (CRLH) transmission line.

2. The portable terminal of claim 1, wherein the first connection member penetrates through the first board.

3. The portable terminal of claim 1, further comprising:

a second board having a conductive pattern thereon, wherein the second board overlaps the first board.

4. The portable terminal of claim 3, further comprising:

a second connection member configured to electrically couple the second patch portion to the conductive pattern.

5. The portable terminal of claim 4, wherein the first patch portion, the second patch portion and the conductive pattern form a first antenna to operate in a first band.

6. The portable terminal of claim 5, wherein the conductor forms a second antenna to operate in a second band.

7. The portable terminal of claim 6, further comprising:

a third board coupled to the first board, and the third board includes a meander pattern thereon.

8. The portable terminal of claim 7, wherein the meander pattern fauns a third antenna to operate in a third band.

9. The portable terminal of claim 3, wherein the conductive pattern is configured in a form of a patch.

10. A portable terminal, comprising:

a body;

a circuit board provided at the body; and an antenna assembly provided at the body, and the antenna assembly includes:

a first board, a first patch portion at a first surface of the first board, a second patch portion at a second surface of the first board, a first connection member to electrically couple the first patch portion to the second patch portion, a ground wire to connect the second patch portion to a ground portion of the circuit board and implement a composite right/left handed (CRLH) transmission line, and a conductor that is spaced a predetermined distance from the second patch portion to provide a capacitive coupling between the conductor and the second patch portion.

11. The portable terminal of claim 10, wherein the first connection member penetrates through the first board.

12. The portable terminal of claim 11, further comprising:

a second board having a conductive pattern thereon, and wherein the second board overlaps the first board.

13. The portable terminal of claim 12, further comprising:

a second connection member configured to electrically couple the second patch portion to the conductive pattern.

14. The portable terminal of claim 13, wherein the first patch portion, the second patch portion and the conductive pattern to fo a first antenna that operates in a first band.

15. The portable terminal of claim 14, wherein the conductor to form a second antenna that operates in a second band.

16. The portable terminal of claim 15, further comprising:

a third board to couple to the first board, and a meander pattern is provided on the third board.

17. The portable terminal of claim 16, wherein the meander pattern to form a third antenna that operates in a third band.

18. The portable terminal of claim 12, wherein the conductive pattern is configured in a form of a patch.

* * * * *